US006386684B1

(12) United States Patent
Brennan et al.

(10) Patent No.: US 6,386,684 B1
(45) Date of Patent: May 14, 2002

(54) CURVED PRINT HEAD FOR CHARGED PARTICLE GENERATION

(75) Inventors: Michael W. Brennan, Hidden Hills; William G. Read, La Canada; William S. Read, Glendale, all of CA (US)

(73) Assignee: Logical Imaging Solutions, Inc., Santa Ana, CA (US)

( * ) Notice: Subject to any disclaimer, the term of this patent is extended or adjusted under 35 U.S.C. 154(b) by 0 days.

(21) Appl. No.: 09/645,016

(22) Filed: Aug. 23, 2000

(51) Int. Cl.[7] ..... B41J 2/04
(52) U.S. Cl. ..... 347/55
(58) Field of Search ..... 347/55, 151, 120, 347/141, 154, 103, 123, 111, 159, 127, 128, 131, 125, 158; 399/271, 290, 292, 293, 294, 295

(56) References Cited

U.S. PATENT DOCUMENTS 4,155,093 A 5/1979 Fotland et al.
4,160,257 A 7/1979 Carrish
4,628,227 A * 12/1986 Briere
4,819,013 A 4/1989 Beaudet
4,992,807 A 2/1991 Thomson
4,999,653 A 3/1991 McCallum
5,006,869 A 4/1991 Buchan et al.
5,159,358 A 10/1992 Kubelik
5,278,588 A 1/1994 Kubelik
5,450,103 A 9/1995 Kubelik
6,145,964 A * 11/2000 Peter ..... 347/55

* cited by examiner

*Primary Examiner*—Raquel Yvette Gordon
(74) *Attorney, Agent, or Firm*—Lyon & Lyon LLP

(57) ABSTRACT

A curved print head is used for generating charged particles at a number of apertures and emitting those charged particles from the apertures to a cylindrical drum. The print head has a radius of curvature larger than the radius of curvature of the drum. The difference in the radius of curvature of the print head and the radius of curvature of the drum is limited by the variation in electric field strength deposited on the drum across the width of the print head.

9 Claims, 2 Drawing Sheets

CURVED PRINT HEAD FOR CHARGED PARTICLE GENERATION

BACKGROUND OF THE INVENTION

The field of this invention is electrostatic printing, and more specifically a print head for charged particle generation.

Electrostatic printing, which is also referred to as ion deposition printing, charge deposition printing or electron beam imaging, has been used successfully for many years in a number of commercial embodiments. The apparatus and method disclosed in U.S. Pat. No. 4,155,093 to Fotland et. al., issued on May 15, 1979, form the basis of modern electrostatic printing technology. A flat print head is used in conjunction with a dielectric drum to create charge patterns on the drum, which attract toner particles. A piece of paper is then pressed into contact with the drum, acquiring the toner particles from the drum to receive a printed image.

Referring to FIG. 1, a typical flat print head 100 known in the art is shown. The flat print head typically includes two sets of selectively-controlled electrodes separated from one another by a high-strength first dielectric 108. The first set of electrodes 102, often referred to as driver electrodes 102, extend along the longer dimension of the print head, typically spanning the width of a page or other paper to be printed upon. The second set of electrodes 104, often referred to as finger electrodes 104, crosses the first electrodes obliquely. The driver electrodes 102 and the finger electrodes 104 form a matrix of crossing junctions between them, referred to as discharge sites 116. To create a charged particle discharge at a particular discharge site 116, a radio frequency (RF) signal of several thousand volts is applied to the driver electrode 102 at that discharge site 116. When a second charge is applied to the finger electrode 104 at that discharge site 116, charged particles are discharged at that discharge site 116 as a low energy spark or electric discharge. The print head 100 may be constructed to discharge either positive or negative charges. The negative charge may contain ions, electrons or a combination of both. The charged particles from a discharge site 116 cross a gap and impact a drum 112, where they are deposited on its dielectric surface 114. The print head 100 is configured such that the charge deposited by each discharge site 116 forms a dot-like latent charge image on the drum. Images or text can be created as aggregations of such dots. Thus, by controlling the discharge of particles from the matrix of discharge sites 116, and rotating the drum 112, images larger than the matrix of discharge sites 116 can be created and transferred onto paper or another surface.

In print heads of this type, RF-driven driver electrodes 102 are typically line conductors extending along the length of the print head, spanning a number of finger electrodes 104 which typically cross the driver electrode 102 at an angle. In an exemplary commercial embodiment, sixteen parallel driver electrodes 102 extend the width of a printed page, and they are crossed obliquely by 160 finger electrodes 104. A discharge site 116 is located at each point where a driver electrode 102 intersects a finger electrode 104. Each finger electrode 104 crosses the driver electrode 102 sixteen times, and can project up to sixteen charge dots, one from each discharge site 116 arranged along its length. According to Gauss' Law, electric field lines originate perpendicular to a conducting surface. Theoretically, charge deposition follows those electric field lines, because electric force is exerted substantially along those field lines. In practice, charge eventually builds up on the drum 112, creating an electric field opposing the existing field. As a result of the presence of the opposing electric field on the drum 112, the charged particles will follow trajectories altered from the ideal trajectories perpendicular to the discharge surface, causing the charge to spread out. This is referred to as the blooming effect. The blooming effect becomes more severe as the distance between the print head 100 and the drum 112 increases, because the electric field generated by the print head 100 weakens with distance, subjecting the charged particles to increased influence from the opposing electric field exerted by the accumulated particles on the drum 112.

Because the print head 100 is flat and the drum 112 is cylindrical, the gap distance between the discharge sites 116 and the drum 112 is not uniform across the width of the print head 100. The electric field between the print head 100 and the drum 112 weakens as the distance between the discharge sites 116 and the longitudinal centerline of the print head 100 increases. In this document, the longitudinal direction is understood to be the direction of the axis of the drum 112. Consequently, the charge deposited on the drum 112 from the discharge sites 116 is not uniform across the width of the print head 100. As a result, the dots produced by the discharge sites 116 located further from the centerline of the print head 100 are weaker than those produced by discharge sites 116 at or near the centerline of the print head 100. This varying charge dot intensity caused by nonuniform charge deposition creates artifacts such as but not limited to smearing and venetian blinding in the image laid down by the drum 112. Venetian blinding is a defect well known to those skilled in the art, in which striations extending parallel to the direction of motion of the drum 112 appear in the image. These striations have different intensities of shading, directly correlating to the different charge intensities deposited on the drum 112 from the discharge sites 116.

A number of different attempts have been made to fix the image artifacts caused by varying charge dot intensity across the print head 100.

One category of attempts to solve the image artifact problem utilizes additional electrodes to better focus the charged particle beam. One or more additional sets of electrodes 106, generally referred to as screen electrodes 106, may be provided between the finger electrodes 104 and the drum 112. The screen electrodes 106 are apertured, and separated from the finger electrodes 104 by a second dielectric 110 having a number of cavities corresponding to the discharge sites 116 and the apertures in the screen electrodes 106. By applying a constant bias between the screen electrodes 106 and the drum 112, and a switchable bias between the screen electrodes 106 and the finger electrodes 104, the screen electrodes 106 act as lenses to improve image quality, and additionally act to prevent accidental erasure of deposited charges. The use of one or more sets of screen electrodes 106 in a print head 100 is described in, for example, U.S. Pat. No. 4,160,257; U.S. Pat. No. 4,675,703; U.S. Pat. No. 5,159,358; and U.S. Pat. No. 5,278,588. While the screen electrodes 106 can improve the quality of the printed image, the addition of one or more electrodes to the print head 100 increases the number of manufacturing steps required, and requires more parts which can malfunction or be damaged as the print head 100 is used. The added complexity of manufacturing also results in increased cost to the end user.

A second category of attempts to solve the image artifact problem modifies the discharge sites 116 or the dielectric material adjacent the discharge sites 116 to improve control over the charged particle stream emitted from the discharge site 116. Such modifications to the discharge site include angling the walls of the dielectric cavity adjacent each discharge site (U.S. Pat. No. 4,691,213; U.S. Pat. No. 4,683,482), providing a number of separate apertures at each discharge site (U.S. Pat. No. 4,879,569), and inserting dielectric material into the second electrode (U.S. Pat. No. 4,891,656). While the modification of the shape and configuration of each individual discharge site 116 can improve the quality of the printed image, the creation of complex discharge sites increases the complexity and cost of manufacturing the print head, resulting in higher manufacturing costs and higher costs to the end user.

A third category of attempts to solve the image artifact problem is disclosed in U.S. Pat. No. 4,819,013 to Beaudet. The print head of Beaudet has a semi-cylindrical surface curved to match exactly the curvature as the drum, such that each point on the print head is equidistant from the drum. That is, the radius of curvature of the drum, added to the perpendicular distance between the surface of the drum and the surface of the print head, equals the radius of curvature of the print head at every point on the print head. In this way, the electric field between the print head and the drum is theoretically identical at each point on the drum. However, the use of a print head curved to match the curvature of the drum causes problems as well. When such a print head is installed in an electrostatic printing machine, it is inevitably misaligned a small amount in a horizontal direction or in a skewed direction over the surface of the print head. Such misalignment may result at best in lower-quality printing, and at worst in physical interference between the print head and the drum that may damage either or both items.

The addition of more electrodes, modifications of the electronics, or differing hole sizes at discharge sites all mask the underlying problems of using a flat print head 100 with a curved drum 112, and can be cumbersome and expensive to implement. In addition, the use of a print head 100 having a curved surface with a radius of curvature identical to that of the drum 112 can result in interference between the two, and in practice does not obtain the results theoretically predicted for such a print head 112 due to inevitable errors in installation of the print head 100 into a printer where it is used. Thus, there is a need for a print head 100 capable of accurately depositing a substantially uniform charge onto a dielectric drum 112 that is tolerant of misalignment and other installation errors.

SUMMARY OF THE PREFERRED EMBODIMENTS

A curved print head is used for generating charged particles at a number of apertures and discharging those charged particles onto a cylindrical drum. The print head has a radius of curvature larger than the radius of curvature of the drum, thereby allowing the print head to accommodate errors in alignment resulting from installation or other factors. Further, stress on the dielectric within the print head is reduced by utilizing a shallower curvature on the print head. The difference in the radius of curvature of the print head and the drum is limited by the variation in electric field strength deposited on the drum across the width of the print head. That electric field variation may not exceed substantially fifteen percent from the center of the print head to either edge of the print head.

DETAILED DESCRIPTION OF THE PREFERRED EMBODIMENTS

Figure 2:
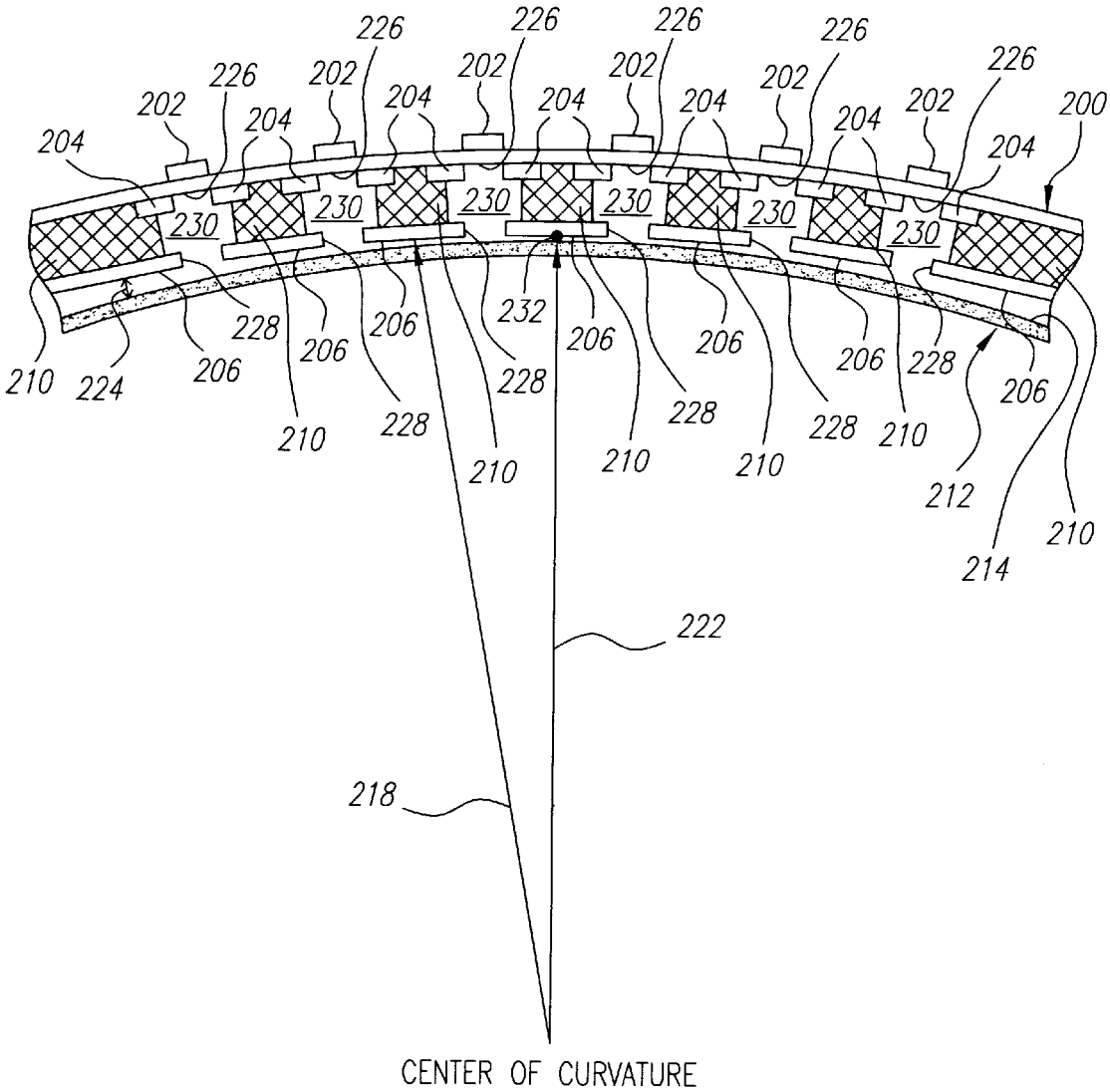
FIG. 2 is a side cross-section view of the print head of the preferred embodiment.

Referring to FIG. 2, the curved print head 200 includes driver electrodes 202 and finger electrodes 204 separated by a first dielectric 208. FIG. 2 shows a side cross-section view of a curved print head 200 where the finger electrodes 204 and the driver electrodes 202 cross at right angles, for clarity in describing the invention. However, the finger electrodes 204 need not cross the driver electrodes 202 at right angles, and indeed preferably cross the driver electrodes at an angle other than perpendicular, as is known to those skilled in the art. The driver electrodes 202 extend in a first direction, which in FIG. 2 is substantially perpendicular to the page, and the finger electrodes 204 extend in a second direction perpendicular to or at an angle to the driver electrodes 202. Each intersection of a driver electrode 202 and a finger electrode 204 creates a discharge site 226 from which charged particles are emitted. Preferably, the first dielectric 208 is composed of muscovite mica, but other dielectrics may be used if desired, such as other types of mica, or KAPTON brand polyimide film manufactured by the DuPont Corporation. The use of two electrodes separated by a dielectric to create a stream of charged particles is well known to those skilled in the art. FIG. 2 shows a single row of discharge sites 226 along the width of the curved print head 200. In a preferred embodiment, multiple rows of discharge sites 226 are provided along the length of the curved print head 200. When current is applied to a driver electrode 202 and a finger electrode 204 crossing at a discharge site 226, charged particles are emitted from the discharge site 226. These charged particles may be positively charged or negatively charged.

Advantageously, the curved print head 200 also includes a screen electrode 206 having a number of apertures 228. The screen electrode 206 is separated from the finger electrode 204 by a second dielectric 210 having a number of cavities 230 corresponding to the discharge sites 226 and to the apertures 228 in the screen electrode 208. The cavities 230 are preferably substantially cylindrical. However, the cavities 230 may take other shapes, if desired. Preferably, the second dielectric 210 is composed of muscovite mica, but other dielectrics may be used if desired, such as other types of mica, or KAPTON brand polyimide film manufactured by the DuPont Corporation. The use of a screen electrode 208 to focus a charged particle beam emitted from a discharge site 226 is well known to those skilled in the art.

A drum 212 has a dielectric surface 214 adapted to receive and hold charged particles emitted from the curved print head 200. The drum 212 is preferably cylindrical, and has a drum radius 222 measured from the axial centerline of the drum 212 to the dielectric surface 214. The screen electrode 206 is curved as well, and has a screen electrode radius 218 measured from the axial centerline of the drum 212 to the surface of the screen electrode 206. The screen electrode 206 is separated from the dielectric surface 214 of the drum 212 at each point by a separation distance 224 measured perpendicular to the dielectric surface 214 at that point. The screen electrode radius 218 must be larger than the drum radius 222. The screen electrode 206 and the dielectric surface 214 are placed together closely enough that the difference between the screen electrode radius 218 and the drum radius 222 results in a separation distance 224 that varies across the width of the screen electrode 206. The drum 212 is preferably closest to the screen electrode 206 along the centerline 232, which is a line through the screen electrode 206 longitudinally bisecting the screen electrode 206. That is, the separation distance 224 is the smallest along the centerline 232. In FIG. 2, the centerline 232 extends substantially perpendicular to the page, intersecting the page at the point labeled 232. The separation distance 224 between the screen electrode 206 and the drum 212 increases with increasing lateral distance from the centerline 232.

In an alternate embodiment, if the screen electrode 206 and second dielectric 210 are not used, the screen electrode radius 218 is measured to the surface of the finger electrodes 204, and the separation distance 224 is measured between the surface of the finger electrodes 204 and the dielectric surface 214. The constraints on the screen electrode radius 218 and the drum radius 222 as disclosed in regard to the preferred embodiment also apply in such an alternate embodiment. In such an alternate embodiment, the finger electrodes 204 are curved in the same manner as the screen electrode 206 as described above.

Figure 1:
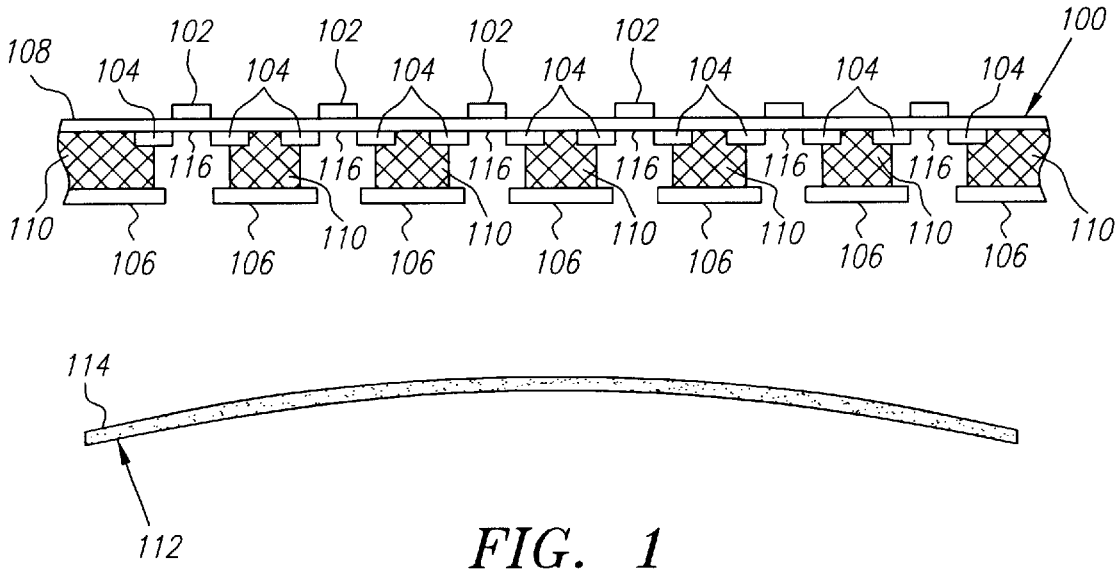
FIG. 1 (PRIOR ART)
FIG. 1 is a side cross-section view of a known flat print head.

The charged particles emitted from a discharge site 226 tend to follow the electric field lines between the curved print head 200 and the drum 212. Because of Gauss' law, absent the screen electrode 206, the electric field lines would tend to extend in substantially straight lines through the cavities 230. Due to the curvature of the curved print head 200, such unmodified field lines come close to depositing charged particles in their ideal locations on the drum 212. Thus, to compensate, the screen electrode 206 need not modify the electric field lines and the corresponding trajectory of the charged particles as strongly as would be required if a flat print head 100 known in the art and shown in FIG. 1 were used. The curved print head 200 thereby reduces the amount of compensation that needs to be provided by the screen electrode 206 to provide an accurate image on the dielectric surface 214 with a plurality of discharge sites 226, allowing for simpler image generation on the drum 212.

The difference in the screen electrode radius 218 and the drum radius 222 is limited by the amount of variation in the electric field across the width of the curved print head 200. The screen electrode radius 218 may be larger than the drum radius 222 by any factor, as long as the electric field generated across the curved print head 200 does not vary by more than substantially fifteen percent from the centerline 232 and the most lateral discharge sites 226. Experience has shown that a fifteen percent variation in the electric field across the curved print head 200 provides good results. In a preferred embodiment, the drum radius 222 is 1.978 inches, and the screen electrode radius 218 is 2.030 inches. At their point of closest separation at the centerline 232, the separation distance 224 preferably is substantially 0.01 inches.

The use of a curved print head 200 having a screen electrode radius 218 larger than the drum radius 222 has three primary advantages. First, the potential for interference between the curved print head 200 and the drum 212 is reduced. Because the screen electrode radius 218 is larger than the drum radius 222, as described above, the curved print head 200 has a shallower curvature than the drum 212, and does not conform to the shape of the dielectric surface 214 at all points on its surface. Thus, the curved print head 200 is better able to tolerate misalignment during installation without interfering with the drum. In a typical application, a print head such as the curved print head 200 is mounted to a handle, which is turn is connected to a socket or other connector within an electrostatic printer (not shown). Due to human error in installation, manufacturing tolerances, or other reasons, the print head 200 is not always, or even not typically, installed within the electrostatic printer in perfect alignment with the drum 212. Rather, the print head 200 may be installed laterally offset with respect to its ideal position, or skewed over the surface of the drum 212. By providing a curved print head 200 that is curved less than the drum 212, the curved print head 200 has clearance at its edges to tolerate horizontal offset without physically interfering with the drum 212 and the dielectric surface 214. Similarly, the curved print head 200 has clearance at its edges to tolerate horizontal offset in opposite directions at opposite ends of the curved print head 200, as occurs when the curved print head 200 is skewed relative to the drum 212.

Second, by providing curvature of the curved print head 200 that is shallower than the curvature of the drum 212, stress on the first dielectric 208 and the second dielectric 210 is reduced. In a preferred embodiment, the first dielectric 208 and the second dielectric 210 are both composed of mica. By reducing the amount of curvature required, the stress on the mica is reduced, which leads to a reduction in the number of parts rejected as a result of breakage caused by stress upon the mica dielectric material.

Third, as described above, the screen electrode 206 needs to perform only a small amount of compensation to ensure that the charged particles emitted from each discharge site 226 impact the dielectric surface 214 in the desired location.

A preferred curved print head for charged particle generation and many of its attendant advantages has thus been disclosed. It will be apparent, however, that various changes may be made in the form, construction and arrangement of the parts without departing from the spirit and scope of the invention, the form hereinbefore described being merely a preferred or exemplary embodiment thereof. Therefore, the invention is not to be restricted or limited except in accordance with the following claims and their legal equivalents.

What is claimed is:

1. A curved print head for electrostatic printing, said print head being cylindrically concave to and for use with a cylindrical drum having an axis and a radius of curvature comprising:

a first electrode extending substantially parallel to the axis of the drum and having a radius of curvature larger than the radius of curvature of the drum, wherein said first electrode is placed relative to the drum such that the distance between said first electrode and the drum varies across the width of the first electrode and extending substantially parallel to the axis of the drum;

a second electrode having a radius of curvature larger than the radius of curvature of the drum, wherein said second electrode is placed relative to the drum such that the distance between said second electrode and the drum varies across the width of the second electrode;

said first and said second electrode having a radius of curvature substantially similar to the radius of curvature of the curved print head; and a dielectric between said first and said second electrode.

2. The print head of claim 1, wherein a discharge site is located where said one first electrode crosses said second electrode.

3. The print head of claim 1, wherein said first electrode and said second electrode generate an electric field between the print head and the drum, and wherein the intensity of said electric field varies no more than substantially fifteen percent between the longitudinal centerline of said second electrode and an edge of the print head.

4. The print head of claim 1, wherein said second electrode is closest to the drum along the longitudinal centerline of said second electrode.

5. The curved print head of claim 1 wherein the said dielectric is selected from the group consisting of mica, aluminum oxide, polyimide film, plastic, ceramic, glass and polyethylene.

6. A curved print head for electrostatic printing, said print head being cylindrically concave to and for use with a cylindrical drum having an axis and a radius of curvature comprising:

a first electrode extending substantially parallel to the axis of the drum and having a radius of curvature larger than the radius of curvature of the drum, wherein said first electrode is placed relative to the drum such that the distance between said first electrode and the drum varies across the width of the first electrode;

a second electrode extending at an angle to the first electrode to form a discharge site and having a radius of curvature larger than the radius of curvature of the drum, wherein said second electrode is placed relative to the drum such that the distance between said second electrode and the drum varies across the width of the second electrode;

a first dielectric between said first electrode and said second electrode;

a third electrode having a radius of curvature larger than the radius of curvature of the drum, wherein said third electrode is placed relative to the drum such that the distance between said second electrode and the drum varies across the width of the third electrode;

said first, said second and said third electrode having a radius of curvature substantially similar to the radius of curvature of the curved print head; and a dielectric between said first and said second electrode.

7. The print head of claim 6, wherein said first electrode, said second electrode and said third electrode generate an electric field between the print head and the drum, and wherein the intensity of said electric field varies no more than substantially fifteen percent between along the longitudinal centerline of said third electrode and an edge of the print head.

8. The print head of claim 6, wherein said third electrode is closest to the drum along the longitudinal centerline of said third electrode.

9. The curved print head of claim 6 wherein the said dielectric is selected from the group consisting of mica, aluminum oxide, polyimide film, plastic, ceramic, glass and polyethylene.

* * * * *